US009797387B2

(12) United States Patent
Aritomi et al.

(10) Patent No.: US 9,797,387 B2
(45) Date of Patent: Oct. 24, 2017

(54) HIGH-PRESSURE FUEL SUPPLY PUMP

(71) Applicant: Hitachi Automotive Systems, Ltd., Hitachinaka-shi, Ibaraki (JP)

(72) Inventors: Shunsuke Aritomi, Tokyo (JP); Satoshi Usui, Hitachinaka (JP); Atsuji Saito, Hitachinaka (JP); Tatsuo Kawano, Hitachinaka (JP); Masayuki Suganami, Hitachinaka (JP); Kenichirou Tokuo, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/032,941

(22) PCT Filed: Oct. 1, 2014

(86) PCT No.: PCT/JP2014/076235
§ 371 (c)(1),
(2) Date: Apr. 28, 2016

(87) PCT Pub. No.: WO2015/064281
PCT Pub. Date: May 7, 2015

(65) Prior Publication Data

US 2016/0281693 A1 Sep. 29, 2016

(30) Foreign Application Priority Data

Oct. 29, 2013 (JP) ..... 2013-223859

(51) Int. Cl.
*F02M 59/46* (2006.01)
*F04B 11/00* (2006.01)
(Continued)

(52) U.S. Cl.
CPC ..... *F04B 11/0091* (2013.01); *F02M 59/368* (2013.01); *F02M 59/462* (2013.01);
(Continued)

(58) Field of Classification Search
CPC ..... F04B 11/0091; F04B 53/16; F04B 53/14; F04B 53/1087; F04B 19/22;
(Continued)

(56) References Cited

U.S. PATENT DOCUMENTS

2007/0119991 A1 5/2007 Schuerg et al.
2012/0288389 A1 11/2012 Kuroyanagi et al.
(Continued)

FOREIGN PATENT DOCUMENTS

JP 2006-526729 A 11/2006
JP 2012-154297 A 8/2012
(Continued)

OTHER PUBLICATIONS

International Search Report (PCT/ISA/210) issued in PCT Application No. PCT/JP2014/076235 dated Jan. 6, 2015 with English-language translation (four (4) pages).
(Continued)

*Primary Examiner* — Hai Huynh
(74) *Attorney, Agent, or Firm* — Crowell & Moring LLP

(57) ABSTRACT

A high-pressure fuel supply pump includes a plunger, a valve member, a valve seat, a pressurizing chamber, and a fuel passage. The fuel passage includes a gap passage portion formed in a gap between the valve seat and the valve member. The fuel passage also includes a bent passage portion extending in a bent direction with respect to the gap passage portion, on the downstream side of the gap passage portion. The inner surface of the valve member, on a side thereof that faces the valve seat, has a convex shape in an area of the valve member that is between the bent passage portion and the gap passage portion.

7 Claims, 9 Drawing Sheets

(51) Int. Cl.

| | |
|---|---|
| ***F02M 59/36*** | (2006.01) |
| ***F04B 19/22*** | (2006.01) |
| ***F04B 53/10*** | (2006.01) |
| ***F04B 53/14*** | (2006.01) |
| ***F04B 53/16*** | (2006.01) |
| ***F02M 63/00*** | (2006.01) |
| *F02M 59/02* | (2006.01) |

(52) U.S. Cl.
CPC ..... *F02M 59/466* (2013.01); *F02M 63/0077* (2013.01); *F02M 63/0078* (2013.01); *F04B 19/22* (2013.01); *F04B 53/1087* (2013.01); *F04B 53/14* (2013.01); *F04B 53/16* (2013.01); *F02M 59/025* (2013.01); *F02M 2200/04* (2013.01); *F02M 2200/28* (2013.01)

(58) Field of Classification Search
CPC ..... F02M 63/0078; F02M 63/0077; F02M 59/462; F02M 59/466; F02M 59/368; F02M 59/025; F02M 2200/28; F02M 2200/04
USPC ..... 123/495; 417/505
See application file for complete search history.

(56) References Cited

U.S. PATENT DOCUMENTS

| | | | |
|---|---|---|---|
| 2014/0048043 | A1 | 2/2014 | Roth et al. |
| 2014/0117268 | A1 | 5/2014 | Deponte et al. |

FOREIGN PATENT DOCUMENTS

| | | | |
|---|---|---|---|
| WO | WO 2012/116850 | A1 | 9/2012 |
| WO | WO 2012/123130 | A1 | 9/2012 |

OTHER PUBLICATIONS

Japanese-language Written Opinion (PCT/ISA/237) issued in PCT Application No. PCT/JP2014/076235 dated Jan. 6, 2015 (five (5) pages).

European Search Report issued in counterpart European Application No. 14858910.4 dated May 11, 2017 (eight pages).

HIGH-PRESSURE FUEL SUPPLY PUMP

TECHNICAL FIELD

The present invention relates to a high-pressure fuel supply pump used for an internal combustion engine.

BACKGROUND ART

As the related art in the present technical field, JP 2012-154297 A (PTL 1) has been disclosed. PTL 1 describes a high-pressure pump (high-pressure fuel supply pump) including a suction valve disposed on the side of a pressurizing chamber of a valve seat formed on a cylindrical valve body fixed to an inner wall of a supply passage. The suction valve seats on the valve seat so that the supply passage closes. The suction valve separates from the valve seat so that the supply passage opens. The high-pressure pump includes a needle that is provided separately from the suction valve, provided so as to capable of abutting on an end surface on the side of the valve seat of the suction valve. The needle includes a movable core at an end portion on the opposite side of an end portion abutting on the end surface on the side of the valve seat of the suction valve. A taper portion having an outer diameter on the side of the suction valve smaller than an outer diameter on the side of the movable core, is disposed on the outside in a diameter direction of the needle, in an inner flow passage formed inside a diameter of the valve body. Accordingly, a direction of a flow of fuel along an outer wall of the taper, varies. Thus, pressure loss of the fuel flowing in the inner flow passage, is reduced (refer to abstract).

CITATION LIST

Patent Literature

PTL 1: JP 2012-154297 A

SUMMARY OF INVENTION

Technical Problem

In the high-pressure pump described in PTL 1, the fuel flows from the side of the pressurizing chamber to the side of a damper chamber in a metering process. In this case, a valve-seat-portion flow passage formed between the valve seat and the suction valve that has separated from the valve seat, and the inner flow passage formed on the downstream side of the valve-seat-portion flow passage, are disposed on the way of a flow passage from the side of the pressurizing chamber to the side of the damper chamber. The valve seat is formed as a plane perpendicular to a central axis line of the needle (hereinafter, referred to as a valve seat surface), and the inner flow passage is formed as an inner flow passage parallel to the central axis line of the needle. Accordingly, a bent flow passage includes the valve-seat-portion flow passage and the inner flow passage perpendicularly interconnecting with each other. In particular, the valve seat surface and an inner circumferential surface of the valve body (outer circumferential surface of the inner flow passage) interconnecting with the valve seat, are included in a flow passage surface on the side of an inner circumference of the bent flow passage. When viewed from a cross-section, parallel to the central axis line of the needle, including the central axis line, the valve seat surface and the inner circumferential surface perpendicularly intersect to each other.

In the high-pressure fuel supply pump having the above structure, the fuel flow from the side of the pressurizing chamber to the side of the damper chamber, detaches from the flow passage surface at a bent portion on the side of the inner circumference of the bent flow passage. Then, a whirlpool occurs. When the fuel passes through the valve seat, air bubbles occur. The air bubbles that have occurred when having passed through the valve seat, remain in proximity to the bent portion on the side of the inner circumference of the bent flow passage, due to the whirlpool. Then, the air bubbles disappear in proximity to the bent portion on the side of the inner circumference. That is, cavitation occurs in proximity to the bent portion on the side of the inner circumference of the bent flow passage. When disappearance of the air bubbles occurs in proximity to the bent portion on the side of the inner circumference, namely, in proximity to the valve seat surface, there is a possibility that erosion occurs on the valve seat surface.

An object of the present invention is to reduce erosion due to cavitation in proximity to a valve seat in a high-pressure fuel supply pump including a fuel flow passage having a bent portion in proximity to the valve seat, formed therein.

Solution to Problem

In order to achieve the above object, a high-pressure fuel supply pump according to the present invention includes: a plunger configured to be in reciprocating motion; a pressurizing chamber of fuel in which volume varies due to the reciprocating motion of the plunger; a fuel passage interconnecting with the pressurizing chamber; and a fluid valve disposed on the fuel passage. The fluid valve includes: a valve seat fixed to the fuel passage; and a valve member held movable by the fuel passage, and configured to close or open the fuel passage by seating on or separating from the valve seat. The fuel passage includes: a gap passage portion formed in a gap between the valve seat and the valve member; and a bent passage portion extending in a bent direction with respect to the gap passage portion, on the downstream side of the gap passage portion. In a case where a flow direction is defined as a reference upon a backflow of the fuel, in terms of a passage surface on the side of an inner circumference of a bent fuel passage portion including the gap passage portion and the bent passage portion, a recess portion is formed on an end portion on the upstream side of a passage surface of the bent passage portion.

Advantageous Effects of Invention

According to the present invention, a fuel flow including air bubbles detaches from a passage surface at a bent portion, and flows to a passage portion on the downstream side over a recess portion formed on a passage surface on the side of an inner circumference of the bent portion. In this case, the inside of the recess portion becomes a region in which the fuel flow has stayed, and the air bubbles flow to the downstream side without staying in proximity to a valve seat. Accordingly, the air bubbles do not disappear in proximity to the valve seat, and disappear at a position away from the valve seat.

Accordingly, occurrence of erosion in proximity to the valve seat can be reduced.

Problems, configurations, and effects other than the above descriptions will be clear in the following embodiments.

DESCRIPTION OF EMBODIMENTS

Embodiments of the present invention will be described below.

First Embodiment

Figure 1:
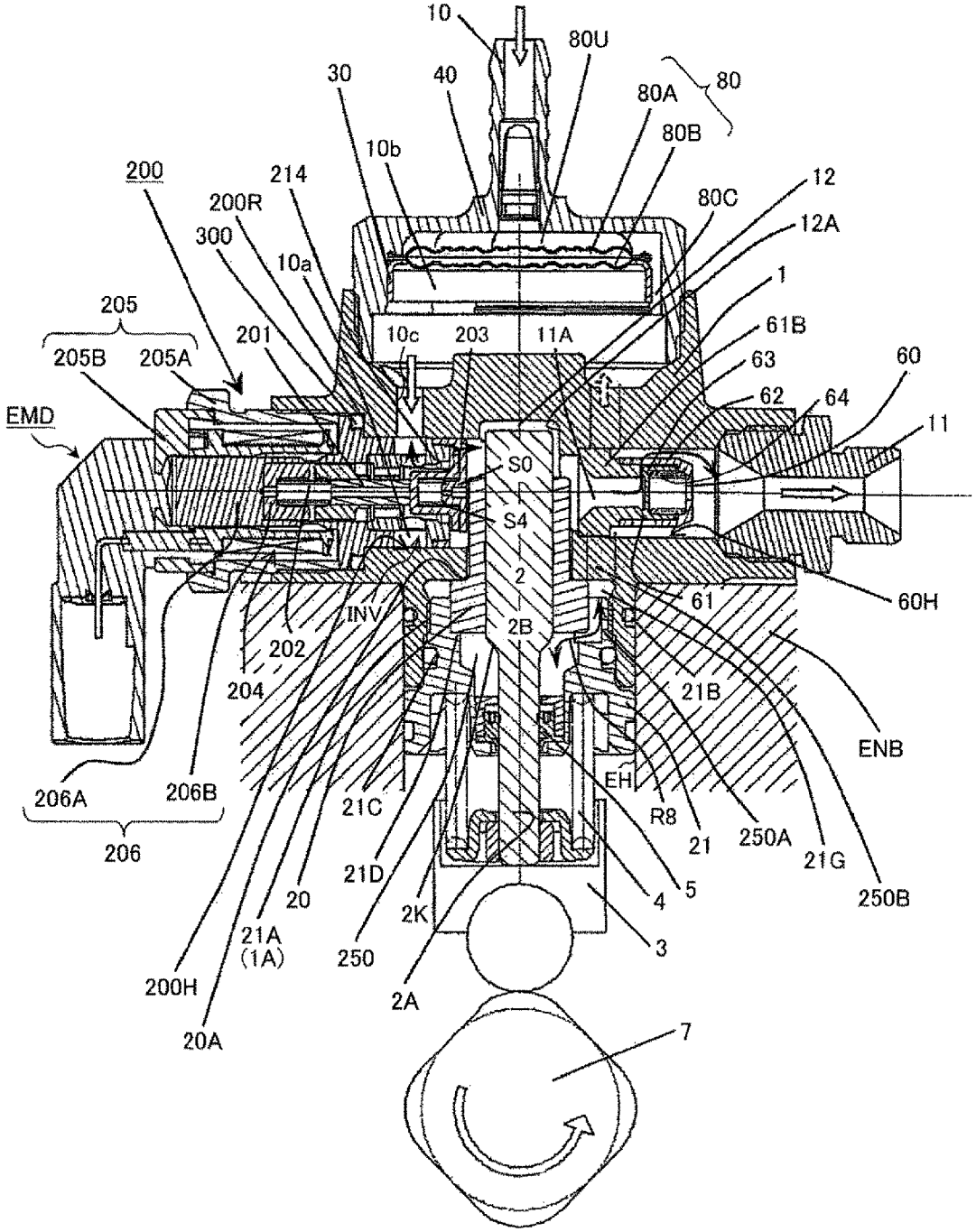
FIG. 1 is a longitudinal sectional view of an entire configuration of a high-pressure fuel supply pump according to a first embodiment of the present invention.
Figure 2:
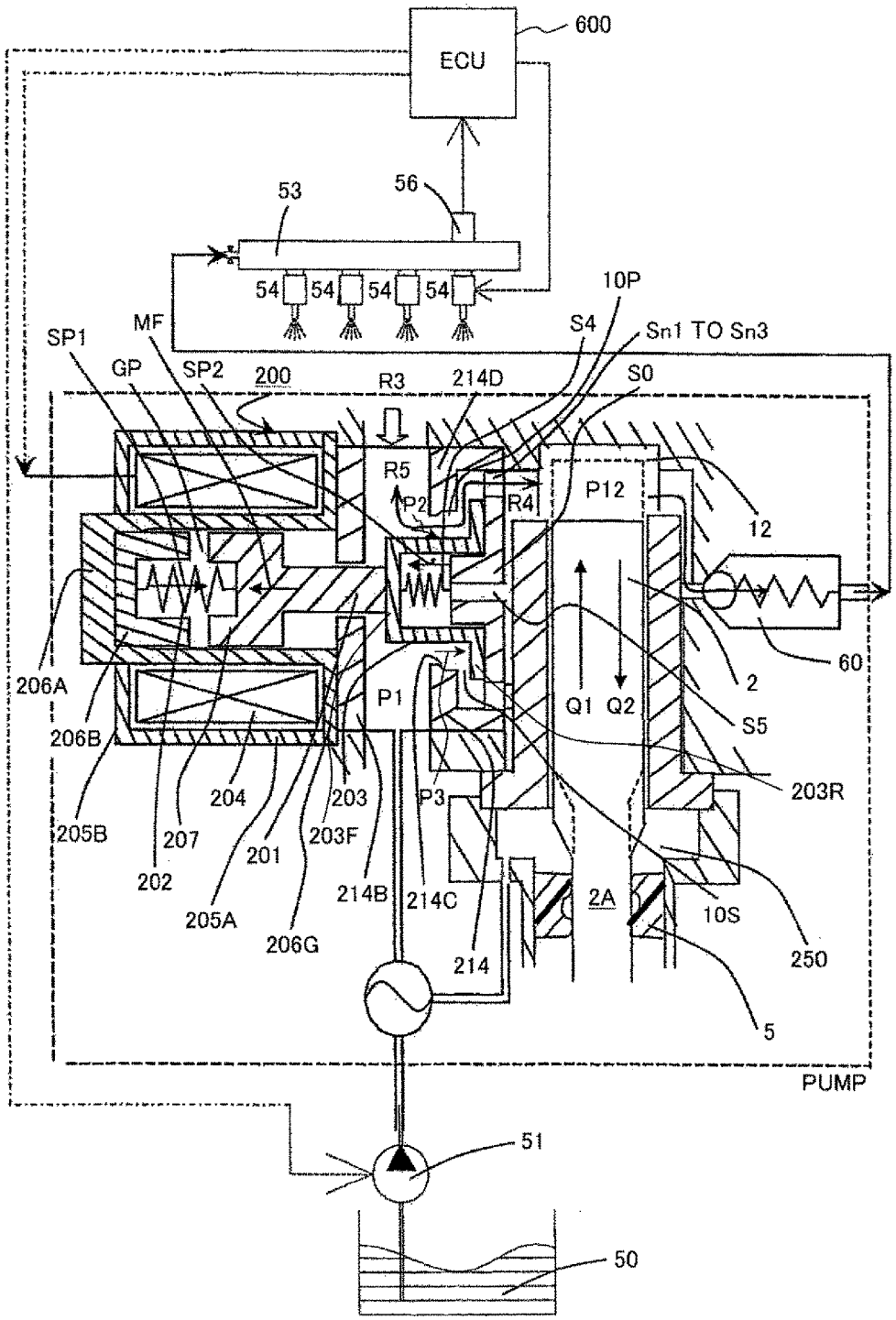
FIG. 2 is a view of an exemplary system configuration of a fuel supply system using the high-pressure fuel supply pump illustrated in FIG. 1.
Figure 3:
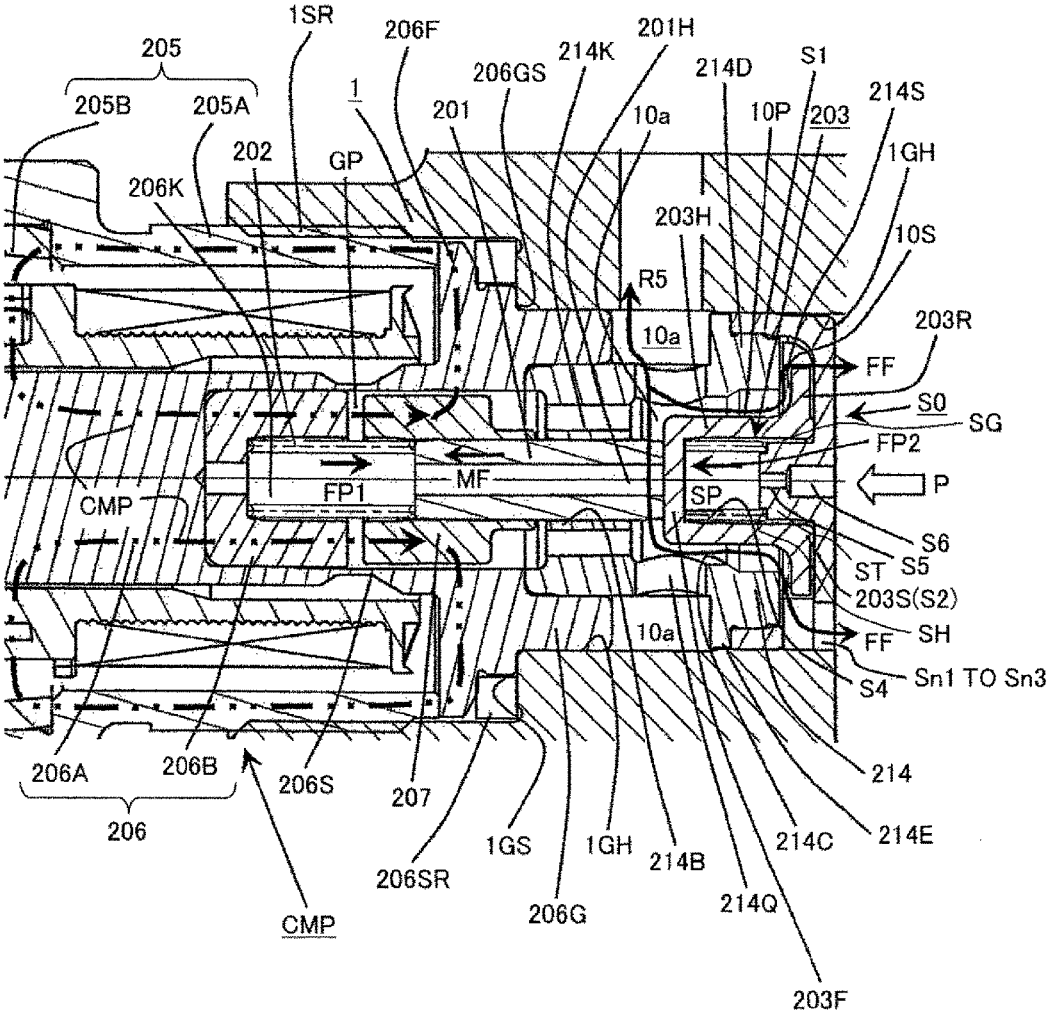
FIG. 3 is a cross-sectional view enlarging and illustrating an electromagnetic-drive-type suction valve in the high-pressure fuel supply pump illustrated in FIG. 1, in a state upon valve-opening (when fuel is sucked and spilled).

An entire configuration of a high-pressure fuel supply pump according to the present invention will be described with reference to FIGS. 1 to 3. FIG. 1 is a longitudinal sectional view of the entire configuration of the high-pressure fuel supply pump according to a first embodiment of the present invention. FIG. 2 is an exemplary system configuration of a fuel supply system using the high-pressure fuel supply pump illustrated in FIG. 1. FIG. 3 is a cross-sectional view enlarging and illustrating an electromagnetic-drive-type suction valve in the high-pressure fuel supply pump illustrated in FIG. 1 in a state upon valve-opening (when fuel is sucked and spilled). Note that, the details in FIG. 1 cannot be denoted with reference signs. The reference signs in the descriptions that are not present in FIG. 1, are present in enlarged drawings to be described later.

A pump housing 1 includes a recess portion 12A that forms a cylindrical space having the base and an open one end. The recess portion 12A includes a cylinder 20 inserted from the side of the open one end thereinto. A pressure contact portion 20A seals a gap between an outer circumference of the cylinder 20 and the pump housing 1. A piston-plunger 2 slidingly fits to the cylinder 20. Fuel that enters into a gap between sliding fit surfaces, seals a gap between an inner circumferential surface of the cylinder 20 and an outer circumferential surface of the piston-plunger 2. As a result, a pressurizing chamber 12 is defined between a leading end of the piston-plunger 2, an inner wall surface of the recess portion 12A, and an outer circumferential surface of the cylinder 20.

A cylindrical hole 200H is formed from a circumferential wall of the pump housing 1 toward the pressurizing chamber 12. The cylindrical hole 200H includes a suction valve portion INV and a part of an electromagnetic drive mechanism portion EMD of an electromagnetic-drive-type suction valve mechanism 200, inserted therein. A faying surface 200R between an outer circumferential surface of the electromagnetic-drive-type suction valve mechanism 200 and the cylindrical hole 200H, comes in close contact with a gasket 300. Thus, the inside of the pump housing 1 is sealed from an atmosphere. The cylindrical hole 200H sealed by fitting the electromagnetic-drive-type suction valve mechanism 200 thereto, functions as a low-pressure fuel chamber 10*a*.

A cylindrical hole 60H is disposed from the circumferential wall of the pump housing 1 toward the pressurizing chamber 12 at a position facing the cylindrical hole 200H through the pressurizing chamber 12. The cylindrical hole 60H includes a delivery valve unit 60 fit thereto. A valve sheet (valve sheet) 61 is formed at a leading end of the delivery valve unit 60. The delivery valve unit 60 includes a valve seat member (valve seat member) 61B having a passage-hole 11A serving as a delivery passage at the center of the delivery valve unit 60. A valve holder 62 for enveloping a periphery on the side of the valve seat 61, is fixed to an outer circumference of the valve seat member 61B. A valve (valve body) 63 and a spring 64 for energizing in a direction in which the valve 63 is pressed in contact with the valve seat 61, are disposed in the valve holder 62. A delivery joint 11 locked and fixed to the pump housing 1 by a screw, is disposed at an opening on the opposite side of the pressurizing chamber of the cylindrical hole 60H.

The electromagnetic-drive-type suction valve mechanism 200 includes a plunger rod 201 to be electromagnetically driven. A valve (valve body) 203 is disposed at a leading end of the plunger rod 201. The valve 203 faces a valve seat (valve seat) 214S formed on a valve housing (valve seat member) 214 disposed on an end portion of the electromagnetic-drive-type suction valve mechanism 200.

A plunger-rod energizing spring 202 is disposed on the other side of the plunger rod 201, and energizes the plunger rod 201 in a direction in which the valve 203 separates from the valve seat 214S. A valve stopper S0 is fixed to a leading-end inner-circumferential portion of the valve housing 214. The valve 203 is held so as to be capable of reciprocating between the valve seat 214S and the valve stopper S0. A valve energizing spring S4 is disposed between the valve 203 and the valve stopper S0. The valve energizing sprig S4 energizes the valve 203 in a direction in which the valve 203 separates from the valve stopper S0.

A leading end of the valve 203 and a leading end of the plunger rod 201 are energized in mutually opposite directions by the valve energizing spring S4 and the plunger-rod energizing spring 202, respectively. However, the plunger-rod energizing spring 202 has a configuration of a spring stronger than that of the valve energizing spring S4. Thus, the plunger rod 201 presses against a force of the valve energizing spring S4 in a direction in which the valve 203 separates from the valve seat 214S (in the right direction in the drawing). As a result, the valve 203 is pressed in contact with the valve stopper S0.

Accordingly, the plunger rod 201 maintains the valve 203 at a valve-opening position by the plunger-rod energizing spring 202 as illustrated in FIGS. 1 to 3 when the electromagnetic-drive-type suction valve mechanism 200 has been turned off (when an electromagnetic coil 204 has not been energized) (the detailed configuration will be described later).

As illustrated in FIG. 2, the fuel is guided by a low-pressure pump 51 from a fuel tank 50 to a suction joint 10 as a fuel introducing port of the pump housing 1 (refer to FIG. 1).

A common rail 53 is equipped with a plurality of injectors 54 and a pressure sensor 56. The plurality of injectors 54 is equipped in accordance with the number of cylinders of an engine. The plurality of injectors 54 jets high-pressure fuel that has been sent to the common rail 53 in response to a signal of an engine control unit (ECU) 600, to the respective cylinders. When pressure in the common rail 53 exceeds a predetermined value, a relief valve mechanism (not illustrated) built in the pump housing 1, opens so as to return surplus high-pressure fuel to the upstream side of the delivery valve 60.

Referring back to FIG. 1, the description will be given. A lifter 3 disposed at a lower end of the piston-plunger 2 is pressed by a spring 4 in contact with a cam 7. The piston-plunger 2 is held by the cylinder 20 so as to be slidable. The piston-plunger 2 is in reciprocating motion due to the cam 7 rotated by, for example, an engine cam shaft, so as to vary capacity in the pressurizing chamber 12. An outer circumference of a lower end portion of the cylinder 20 is held by a cylinder holder 21. Fixing the cylinder holder 21 to the pump housing 1 presses the cylinder 20 with a metal sealing portion 20A in contact with the pump housing 1.

The cylinder holder 21 is equipped with a plunger seal 5 for sealing an outer circumference of a small-diameter portion 2A formed on the side of a lower end portion of the piston-plunger 2. An assembly of the cylinder 20 and the piston-plunger 2 is inserted in the pressurizing chamber. A male screw portion 21A formed on an out circumference of the cylinder holder 21, is screwed into a screw portion 1A of a female screw portion formed on an inner circumference of an end portion on the open side of a recess 12A of the pump housing 1. In a state where a step portion 21D of the cylinder holder 21 has been locked into a circumferential edge of an end portion on the opposite side of the pressurizing chamber of the cylinder 20, the cylinder holder 21 presses the cylinder 20 to the side of the pressurizing chamber. Accordingly, the step portion 20A for sealing the cylinder 20 is pressed in contact with the pump housing 1 and a seal portion is formed due to metal contact.

An O-ring 21B seals a gap between an inner circumferential surface of a fitting hole EH formed on the engine block ENB, and an outer circumferential surface of the cylinder holder 21. An O-ring 21C seals a gap between an inner circumferential surface of an end portion on the opposite side of the pressurizing chamber of the recess 12A of the pump housing 1, and the outer circumferential surface of the cylinder holder 21, at a position on the opposite side of the pressurizing chamber of the screw portion 21A (1A).

A pump is screwed to the engine block by a flange of the pump housing 1 (the details are omitted) so as to be fixed to the engine block.

A damper chamber 10*b* is formed on the way of a passage between the suction joint 10 and the low-pressure fuel chamber 10*a*. A two-metal-diaphragm-type damper 80 is clamped between a damper holder 30 and a damper cover 40 so as to be housed in the damper chamber 10*b*. The double metal diaphragm damper 80 includes a pair of upper and lower metal diaphragms 80A and 80B facing to each other. An outer circumferential portion of the pair of upper and lower metal diaphragms 80A and 80B, is welded over the circumference so that the inside is sealed.

Inert gas, such as argon, is filled in a cavity formed by the double metal diaphragms 80A and 80B. Volume of the cavity varies in accordance with an outer pressure variation so as to perform a pulsation damping function.

Specifically, a step portion is formed on an inner circumference of the damper cover 40. A ring-shaped groove is disposed on the step portion. An outer circumferential welded portion of the two-metal-diaphragm-type damper 80 is fit into the groove so that an external force is prevented from acting from a wall surface of the periphery. A surface inside the outer circumferential welded portion of a surface on the one side of the two-metal-diaphragm-type damper (surface on the side of the suction joint 10 of the damper cover) 80 is disposed so as to be held at the step portion. The damper holder 30 includes a cup-shaped member having no bottom (member including a hole at the center and having a curved surface with a cross-section bending inside, around the hole). An outer circumference of the damper holder 30 is pressed and fit to an inner circumferential surface of the damper cover 40. An end surface portion of a bent portion abuts on a ring-shaped surface on the inside of the outer circumferential welded portion of the two-metal-diaphragm-type damper 80 over the entire circumference. In a state where a flange portion of the two-metal-diaphragm-type damper 80 has been clamped between this abutting region and the step portion described above, the two-metal-diaphragm-type damper 80 is integrally formed with the damper holder 30 and the damper cover 40 as one assembly (unit). Thus, the damper chamber 10*b* is formed by screwing and joining the pump housing 1 and the damper cover 40. According to the present embodiment, the suction joint 10 is integrally formed with the damper cover 40 so as to be perpendicular to a central portion of an upper surface of the damper cover 40. Accordingly, even when a screw portion formed on an outer circumference of the damper cover 40 is screwed to a screw portion engraved on an inner wall of the pump housing 1, an attitude of the suction joint 10 remains the same at any positions in a direction of rotation. A position at which the damper cover is screwed, is not limited. Thus, assembly of the damper cover 40 is improved.

A fuel passage 80U between the diaphragm 80A on one side of the double metal diaphragm damper 80 and the damper cover 40, interconnects with the damper chamber 10*b* (fuel passage facing the diaphragm 80B on the other side of the double metal diaphragm damper 80) as a fuel passage through a groove passage 80C disposed on an inner circumferential wall of the damper cover 40. The damper chamber 10*b* interconnects with the low-pressure fuel chamber 10*a* at which the electromagnetic-drive-type suction valve 20 is positioned, by a interconnecting hole 10*c* formed in the pump housing 1 forming a bottom wall of the damper chamber 10*b*. Thus, the fuel sent from a feed pump 50 flows from the suction joint 10 to the damper chamber 10*b* of the pump. The fuel flows to the low-pressure fuel chamber 10*a* through the interconnecting hole 10*c* while acting on both of the diaphragms 80A and 80B of the double metal diaphragm damper 80.

A connection portion between the small-diameter portion 2A of the piston-plunger 2 and a large-diameter portion 2B slidingly fitting to the cylinder 21, includes a conical surface 2K. A fuel sub-chamber 250 is formed between the plunger seal 5 and a lower end surface of the cylinder 21 around the conical surface. The fuel sub-chamber 250 receives the fuel leaking from the sliding fit surface between the cylinder 20 and the piston-plunger 2. A ring-shaped passage 21G is separately formed between an inner circumferential surface of the pump housing 1, the outer circumferential surface of the cylinder 21, and an upper end surface of the cylinder holder 21. One end of the ring-shaped passage 21G is coupled to the damper chamber 10*b* through a longitudinal passage 250B formed through the pump housing 1, and the other interconnects with the fuel sub-chamber 250 through a fuel passage 250A formed in the cylinder holder 21. Thus, the damper chamber 10A and the fuel sub-chamber 250 interconnects with each other through the longitudinal passage 250B, the ring-shaped passage 21G, and a fuel passage 250A.

The piston-plunger 2 starts in up-and-down motion (reciprocating motion) so that a taper surface 2K starts in reciprocating motion in the fuel sub-chamber. Thus, capacity of the fuel sub-chamber 250 varies. When the capacity of the fuel sub-chamber 250 increases, the fuel flows from the damper chamber 10*b* to the fuel sub-chamber 250 through the longitudinal passage 250B, the ring-shaped passage 21G, and the fuel passage 250A. When the capacity of the fuel sub-chamber 250 decreases, the fuel flows from the fuel sub-chamber 250 to the damper chamber 10*b* through the longitudinal passage 250B, the ring-shaped passage 21G, and the fuel passage 250A. In a state where the valve 203 remains at the valve-opening position (state where the coil 204 has not been energized), when the piston-plunger 2 ascends from a bottom dead center, the fuel sucked in the pressurizing chamber overflows (spills) from the opening suction valve 203 to the low-pressure fuel chamber 10*a*, and flows to the damper chamber 10*b* through the interconnecting hole 10*c*. Thus, the damper chamber 10*b* has a configuration in which the fuel from the suction joint 10, the fuel from the fuel sub-chamber 250, the overflowing fuel from the pressurizing chamber 12, and the fuel from the relief valve (not illustrated) join together. As a result, fuel pulsation of the fuel from the suction joint 10, fuel pulsation of the fuel from the fuel sub-chamber 250, fuel pulsation of the overflowing fuel from the pressurizing chamber 12, and fuel pulsation of the fuel from the relief valve, join together in the damper chamber 10*b* and then are absorbed by the double metal diaphragm damper 80.

In FIG. 2, a region enclosed by a dashed line indicates a portion of the pump body illustrated in FIG. 1. The electromagnetic-drive-type suction valve 200 includes a yoke 205 serving as a body of the electromagnetic drive mechanism portion EMD, on the side of an inner circumference of the coil 204 formed to be ring-shaped. An inner circumferential portion of the yoke 205 houses a fixed core 206 and an anchor 207 through the plunger-rod energizing spring 202.

As illustrated in detail in FIG. 3, according to the present embodiment, the yoke 205 includes a side yoke 205A and an upper yoke 205B separated. The side yoke 205A and the upper yoke 205B are pressed fit and joined. The fixed core 206 includes an outer core 206A and an inner core 206B separated. The outer core 206A and the inner core 206B are pressed fit and joined. The anchor 207 is fixed to an end portion on the opposite side of the valve of the plunger rod 201, by welding. The anchor 207 faces the inner core 206B through a magnetic gap GP. The coil 204 is housed in the yoke 205. A screw portion disposed on an outer circumference of an open end portion of the side yoke 205A, is screwed and locked to a screw portion 1SR of the pump housing 1 so that the coil 204 and the yoke 205 are fixed together. By the fixing work, the open end portion of the side yoke 205A presses a flange portion 206F formed on an outer circumference of the outer core 206A, to the pump housing. In addition, an outer circumference of a cylindrical portion 206G of an end portion on the open side of the outer core 206A, is inserted in an inner circumferential surface of a guide hole 1GH of the pump housing 1. A ring-shaped diameter expanding portion 206GS, as a shoulder portion, formed on an outer circumference of the cylindrical portion 206G of an end portion on the open side of the outer core 206A, is pressed in contact with a ring-shaped surface portion 1GS formed around the open side of the guide hole 1GH of the pump housing 1. In this case, a seal ring 206SR arranged between the ring-shaped surface portion 1GS formed around the open side of the guide hole 1GH of the pump housing 1 and the flange portion 206F formed on the outer circumference of the outer core 206A, is compressed. Accordingly, a space, on the low-pressure side, including a space of an inner circumferential portion of the fixed core 206 and the low-pressure fuel chamber 10*a*, is sealed with respect to the atmosphere.

A closed magnetic circuit CMP passing through the magnetic gap GP, is formed around the coil 204 by the side yoke 205A, the upper yoke 205B, the outer core 206A, the inner core 206B, and the anchor 207. A portion facing around the magnetic gap GP of the outer core 206A, is formed to have a thin thickness (a groove is formed when viewed from the outer circumference). The groove portion forms a magnetic throttle 206S (having a function of magnetic resistance) of the closed magnetic circuit CMP. Accordingly, a magnetic flux leaking through the outer core 206A can be reduced. As a result, a magnetic flux passing through the magnetic gap GP can increase.

Operation of the high-pressure fuel supply pump according to the present embodiment will be described with reference to FIGS. 1 to 3.

<<Fuel Sucking State>>

First, a fuel sucking state will be described. The coil 204 is in a non-energization state, in a suction process in which the piston-plunger 2 descends from a top dead center position indicated by a dotted line in FIG. 2 in a direction illustrated by an arrow Q2. An energizing force SP1 of the plunger-rod energizing spring 202 energizes the plunger rod 201 toward the valve 203 as illustrated by an arrow. Meanwhile, an energizing force SP2 of the valve energizing spring S4 energizes the valve 203 in a direction illustrated by an arrow. Since the energizing force SP1 of the plunger-rod energizing spring 202 is set so as to be larger than the energizing force SP2 of the valve energizing spring S4 in energizing force, in this case, the energizing forces of both of the springs energize the valve 203 in a valve-opening direction. The valve 203 receives a force in the valve-opening direction, by a pressure difference between static pressure P1 of the fuel acting on an outer surface of the valve 203 represented by a plane portion 203F of the valve 203 positioned in the low-pressure fuel chamber 10*a*, and pressure P12 of the fuel in the pressurizing chamber. Further, a fluid frictional force P2 occurring between a fuel flow flowing in the pressurizing chamber 12 along an arrow R4 through a fuel introducing passage 10P, and a circumferential surface of a cylindrical portion 203H of the valve 203, energizes the valve 203 in the valve-opening direction. Still further, dynamic pressure P3 of the fuel flow passing through a ring-shaped fuel passage 10S formed between the valve seat 214S and a ring-shaped surface portion 203R of the valve 203, acts on the ring-shaped surface portion 203R of the valve 203 and energizes the valve 203 in the valve-opening direction. The valve 203 having a few milligrams in weight, promptly opens by these energizing forces when the piston-plunger 2 starts to descend. The valve 203 strokes until colliding against the stopper S0.

The valve seat 214 is formed on the outside of the cylindrical portion 203H of the valve 203 and the fuel introducing passage 10P in a diameter direction. Accordingly, an area on which P1, P2, and P3 act, can increase. A valve-opening speed of the valve 203 can be accelerated. In this case, the periphery of the plunger rod 201 and the anchor 207 is filled with the fuel that has remained, and a frictional force acts on the bearing 214B so that a stroke of the plunger rod 201 and the anchor 207 in the right direction in the drawing becomes slightly later than the valve-opening speed of the valve 203. As a result, a slight gap is made between a leading end surface of the plunger rod 201 and the plane portion 203F of the valve 203. Accordingly, a valve-opening force given by the plunger rod 201, decreases for an instant. However, the pressure P1 of the fuel in the low-pressure fuel chamber 10*a* acts on the gap without delay. Thus, a fluid force in the valve-opening direction of the valve 203 covers the degradation of the valve-opening force given by the plunger rod 201 (plunger-rod energizing spring 202). Thus, when the valve 203 opens, static pressure and dynamic pressure of the fluid act on an entire surface on the side of the low-pressure fuel chamber 10*a* of the valve 203. Therefore, the valve-opening speed accelerates.

When the valve 203 opens, an inner circumferential surface of the cylindrical portion 203H of the valve 203 is guided by a valve guide formed by a cylindrical surface SG of a protruding portion ST of the valve stopper S0. Thus, the valve 203 smoothly strokes without displacement in a radius direction. The cylindrical surface SG forming the valve guide, is formed across the upstream side and the downstream side of a plane including the valve seat 214S formed thereon, and the plane. The stroke of the valve 203 can be sufficiently covered and a dead space on the side of an inner circumference of the valve 203 can be effectively used. Therefore, the length in an axial direction of the suction valve portion INV, can be shortened. The valve energizing spring S4 is disposed between an end surface SH of the valve stopper S0 and a bottom surface portion on the side of the valve stopper S0 of the plane portion 203F of the valve 203. As a passage area of the fuel introducing passage 10*p* formed between an opening 214P and the cylindrical portion 203H of the valve 203 is sufficiently secured, the valve 203 and the valve energizing spring S4 can be disposed on the inside of the opening 214C. The dead space on the side of the inner circumference of the valve 203 positioned on the inside of the opening 214C forming the fuel introducing passage 10*p*, is effectively used so that the valve energizing spring S4 can be disposed. Therefore, the length in the axial direction of the suction valve portion INV, can be shortened.

The valve 203 includes a valve guide SG at the central portion thereof. The valve 203 includes a ring-shaped protruding portion 203S in contact with a receiving surface S2 of a ring-shaped surface portion S3 of the valve stopper S0 on an outer circumference adjacent to the valve guide SG. Furthermore, the valve seat 214S is formed at a position on the outside in the radius direction of the valve 203. Three fuel passages Sn1 to Sn3 including, as a passage wall surface, the guide hole 1GH formed in the pump housing 1, are arranged at regular intervals in a circumferential direction of the guide hole 1GH, on the outside in a radius direction of the valve seat 214S and the ring-shaped surface portion 203R of the valve 203. Since the fuel passages Sn1 to Sn3 are formed on the outside in the radius direction of the valve seat 214S, there is an advantage that sectional areas of the fuel passages Sn1 to Sn3 can be sufficiently and largely secured.

A ring-shaped gap SGP is disposed on an outer circumferential portion of the ring-shaped protruding portion 203S. Therefore, upon valve-closing operation, fluid pressure P4 on the side of the pressurizing chamber, promptly act on the ring-shaped gap SGP so that a valve-closing speed when the valve 203 is pressed in contact with the valve seat 214, can be accelerated.

<<Fuel Spilling State>>

Next, a fuel spilling state will be descried. The piston-plunger 2 starts to ascend in reverse from the bottom dead center position in a direction of an arrow Q1. However, since the coil 204 is in a non-energization state, part of the fuel sucked in the pressurizing chamber 12 once is spilled (overflowed) to the low-pressure fuel chamber 10*a* through the fuel passages Sn1 to Sn3, the ring-shaped fuel passage 10S, and the fuel introducing passage 10P. When a fuel flow in each of the fuel passages Sn1 to Sn3 turns from a direction of the arrow R4 to a direction of an arrow R5 (refer to FIG. 2), the fuel flow stops for an instant and pressure of the ring-shaped gas SGP increases. In this case, the plunger-rod energizing spring 202 presses the valve 203 in contact with the stopper S0. That is, the valve 203 is securely pressed in contact with the stopper S0 by a fluid force pressing the valve 203 in contact with the side of the stopper S0 due to dynamic pressure of the fuel flowing in the ring-shaped fuel passage 10S of the valve seat 214, and a fluid force acting to attract the valve 203 and the stopper S0 to each other due to a jet effect of the fuel flow flowing in an outer circumference of the ring-shaped gap SGP.

After an instant in which the fuel flow turns in the direction of R5, the fuel in the pressurizing chamber 12 flows in the low-pressure fuel chamber 10*a* through the fuel passages Sn1 to Sn3, the ring-shaped fuel passage 10S, and the fuel introducing passage 10P in this order. Here, a fuel flow passage sectional area of the fuel passage 10S is set to be smaller than fuel flow passage sectional areas of the fuel passages Sn1 to Sn3 and the fuel introducing passage 10P. That is, the fuel flow passage sectional area of the ring-shaped fuel passage 10S is set to be smallest. Therefore, a pressure drop occurs in the ring-shaped passage 10S and pressure in the pressurizing chamber 12 increases. However, since the fluid pressure P4 is received by a ring-shaped surface on the side of the pressurizing chamber of the stopper S0, and barely acts on the valve 203. In addition, since an equalizing hole S5 has a small hole diameter, the dynamic fluid force of the fuel on the side of the pressurizing chamber 12, illustrated by the arrow P4, barely acts on the valve 203.

In the spilling state, the fuel flows from the low-pressure fuel chamber 10*a* to the damper chamber 10*b* through four fuel-through-holes 214Q. Meanwhile, the piston-plunger 2 ascends so that the capacity of the sub-fuel chamber 250 increases. Thus, the fuel flows in the longitudinal passage 250B, the ring-shaped passage 21G, and the fuel passage 250A in a downward arrow direction of an arrow R8. Part of the fuel is introduced from the damper chamber 10*b* to the fuel sub-chamber 250. Thus, since the cool fuel is supplied to the fuel sub-chamber, a sliding portion between the piston-plunger 2 and the cylinder 20, is refrigerated.

<<Fuel Delivering State>>

Next, a fuel delivering state will be described. In the fuel spilling state described above, when the coil 204 is energized based on an instruction from an engine control unit ECU, a magnetic flux flowing in the closed magnetic circuit CMP, occurs as illustrated in FIG. 3. When the magnetic flux flowing in the closed magnetic circuit CMP has occurred, a magnetic sucking force MF occurs between a surface of the inner core 206B and a surface the anchor 207 facing each other in the magnetic gap GP. This magnetic sucking force defeats the energizing force of the plunger-rod energizing spring 202, and attracts the anchor 207 and the plunger rod 201 fixed thereto to the inner core 206B. In this case, the fuel in the magnetic gap GP and in a housing chamber 206K of the plunger-rod energizing spring 202, discharges to a low-pressure passage through a through-hole 201H or discharges from the fuel passage 214K to the low-pressure passage through the periphery of the anchor 207. Accordingly, the anchor 207 and the plunger rod 201 is smoothly displaced to the side of the inner core 206B. When the anchor 207 comes in contact with the inner core 206B, the anchor 207 and the plunger rod 201 stop motion.

The plunger rod 201 is attracted to the inner core 206B so that the energizing forces pressing the valve 203 in contact with the side of the stopper S0, disappears. Thus, the valve 203 is energized in a direction departing from the stopper S0 due to the energizing force of the valve energizing force spring S4. The valve 203 starts valve-closing motion. In this case, the pressure in the ring-shaped gap SGP positioned on the side of an outer circumference of the ring-shaped protruding portion 203S, becomes higher than pressure on the side of the low-pressure fuel 10*a* in accordance with a pressure rise in the fuel pressurizing chamber 12, and supports the valve-closing motion of the valve 203. As a result, the valve 203 comes in contact with the seat 214 so as to be in the valve-closing state. In FIG. 3, the ring-shaped fuel passage 10S formed between the valve seat 214 and the ring-shaped surface portion 203R of the valve 203, closes.

As described above, the spring-shaped gap SGP has an effect of supporting the valve-closing motion of the valve 203. However, the valve-closing motion is unstable with only the valve energizing spring S4 because a valve-closing force of the suction valve is too small. Thus, disposing equalizing holes S5 and S6 causes the fuel to be supplied to a spring housing space SP through the equalizing holes S5 and S6 when the valve 203 closes. Accordingly, pressure in the spring housing space SP becomes constant and a force acting when the valve 203 closes, becomes stable. Thus, valve-closing timing of the valve 203 can be stable. In addition, responsiveness of each of the valve-opening and the valve-closing of the valve can be improved. Furthermore, valve-closing time variation can be reduced.

The piston plunger 2 continuously ascends even after the valve-closing of the valve 203. Thus, the capacity of the pressurizing chamber 12 decreases and the pressure in the pressurizing chamber 12 increases. As a result, as illustrated in FIGS. 1 and 2, a delivery valve 63 of the delivery valve unit 60 defeats the delivery valve energizing spring 64 in force so as to separate from the valve seat 61. The fuel discharges from the delivery passage 11A through the delivery joint 11 in a direction of an arrow R6.

As described above, the spring-shaped gap SGP has an effect of supporting the valve-closing motion of the valve 203. However, the valve-closing motion is unstable with only the valve energizing spring S4 because a valve-closing force of the suction valve is too small. Disposing the equalizing holes S5 and S6 supplies the fuel to the spring housing space SP through the equalizing holes S5 and S6 when the valve 203 closes. Thus, the pressure in the spring housing space SP becomes constant, and the force acting when the valve 203 closes, becomes stable. Thus, the valve-closing timing of the valve 203 can be stable. Accordingly, the responsiveness of each of the valve-opening and the valve-closing of the valve can be improved. Furthermore, the valve-closing time variation can be reduced.

<<Configuration of Reducing Erosion of the Valve Seat Due to Cavitation>>

A configuration of reducing erosion at the valve seat 214S of the valve housing 214 or at the valve seat 61 of the delivery valve unit 60, will be described below.

Figure 9:
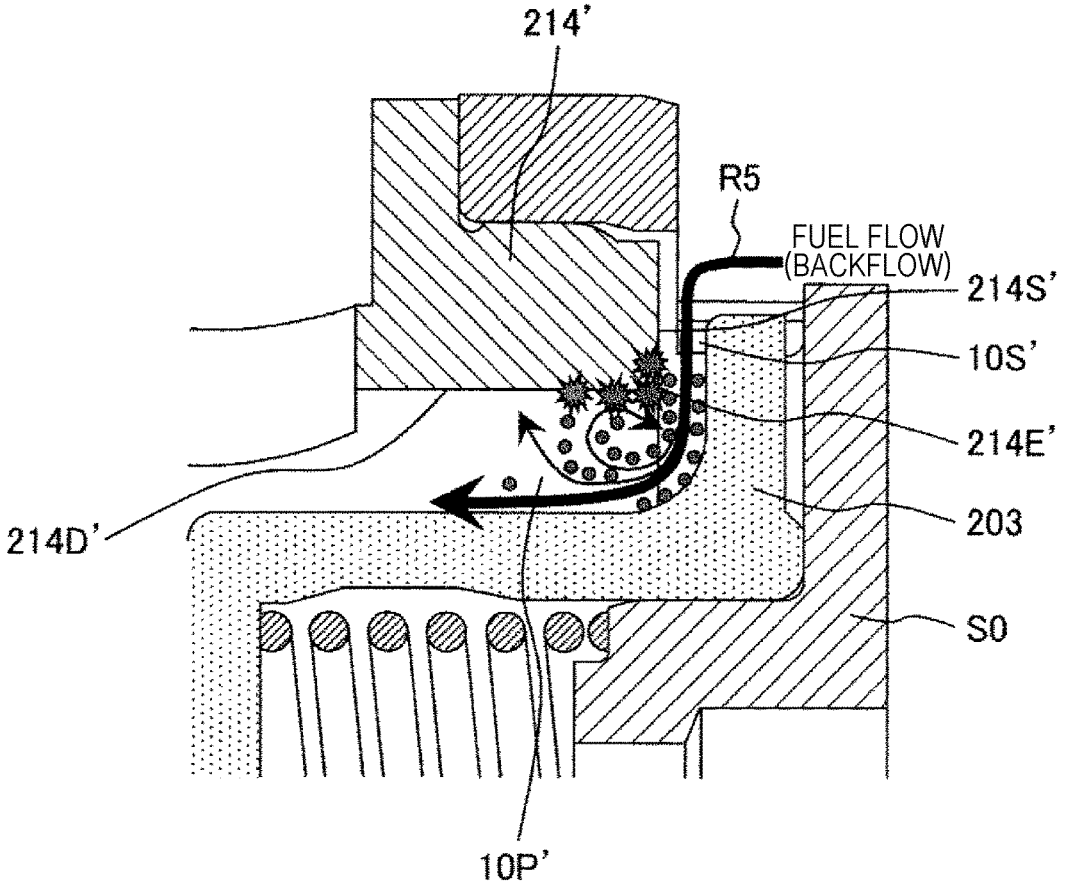
FIG. 9 is a cross-sectional view of proximity to a valve seat and a valve member in an electromagnetic-drive-type suction valve, illustrating a state upon a backflow, as a comparative example with the present invention.

First, a comparative example with the present embodiment, will be described with reference to FIG. 9. FIG. 9 is a cross-sectional view of proximity to a valve seat 214S' and a valve 203 in an electromagnetic-drive-type suction valve, illustrating a state upon a backflow, as the comparative example with the present embodiment.

In the fuel spilling state described above, the fuel flows from the side of the pressurizing chamber 12 to the side of the damper chamber 10*b*, and has the backflow with respect to the fuel flow in the fuel delivering state described above. In the following descriptions, the backflow state is defined as a reference, and an upstream side and a downstream side are set.

A ring-shaped fuel passage (valve seat portion passage) 10S' formed between the valve seat (valve seat) 214S' and the valve (valve member) 203, and a fuel introducing passage 10P' formed on the downstream side of the ring-shaped fuel passage 10S', are disposed on the way of a fuel passage from the side of the pressurizing chamber 12 to the side of the damper chamber 10*b*. The valve seat 214S' is formed as a plane perpendicular to a central axis line of the plunger rod 201 (drive axis line of the valve 203) (hereinafter, referred to as a valve seat surface), and the fuel introducing passage 10P' is formed as a fuel passage parallel to the central axis line of the plunger rod 201. Accordingly, a bent flow passage includes the ring-shaped fuel passage 10S' and the fuel introducing passage 10P' perpendicularly interconnecting with each other. In particular, the valve seat 214S' and an inner circumferential surface (an outer circumferential surface of the fuel introducing passage 10P') 214D' of the valve housing 214' interconnecting with the valve seat 214S', are included in a flow passage surface on the side of an inner circumference of the bent portion. When viewed from a cross-section, parallel to the central axis line of the plunger rod 201, including the central axis line, the valve seat 214S' and the inner circumferential surface 214D' perpendicularly intersect to each other.

Note that, the ring-shaped fuel passage (valve seat portion passage) 10S' is a fuel passage portion formed in a gap between the valve seat (valve seat) 214S' and the valve (valve member) 203. In the present description, the ring-shaped fuel passage (valve seat portion passage) 10S' may be referred to as a radius direction passage portion 10S' or a gap passage portion 10S'. The fuel introducing passage 10P' is a fuel passage portion extending on the downstream side of the gap passage portion 10S' in a bent direction with respect to the gap passage portion 10S'. In the present description, the fuel introducing passage 10P' may be referred to as an axial direction passage portion 10P' or a bent passage portion 10P'.

In a high-pressure fuel supply pump with the above configuration, a fuel flow from the side of the pressurizing chamber 12 to the side of the damper chamber 10*b*, detaches from the flow passage surface at a bent portion 214E' on the side of an inner circumference of the bent portion. Then, a whirlpool occurs. When the fuel passes through the valve seat 214S', air bubbles occur. The air bubbles that has occurred when having passed through the valve seat 214S', remain in proximity to the bent portion 214E' on the side of the inner circumference due to the whirlpool. The air bubbles disappear in proximity to the bent portion 214E' on the side of the inner circumference. That is, cavitation occurs in proximity to the bent portion 214E' on the side of the inner circumference. When disappearance of the air bubbles occurs in proximity to the bent portion on the side of the inner circumference, namely, in proximity of the valve seat surface, there is a possibility that the erosion occurs on the valve seat (seat surface) 214S'.

Figure 4:
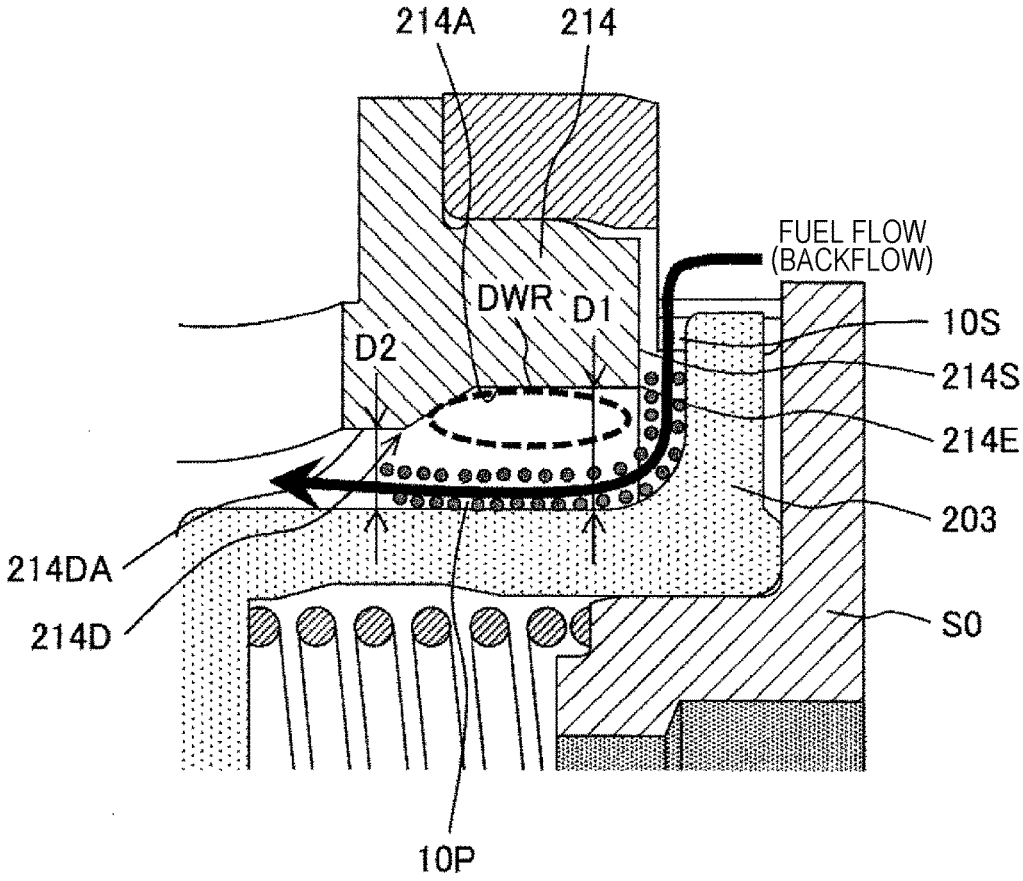
FIG. 4 is a cross-sectional view of proximity to a valve seat and a valve member in the electromagnetic-drive-type suction valve, in a state upon a backflow.

Next, a configuration according to the present embodiment will be described with reference to FIG. 4. FIG. 4 is a cross-sectional view of proximity to the valve seat 214S and the valve 203 in the electromagnetic-drive-type suction valve, illustrating a state upon a backflow.

On the way of a fuel passage from the side of the pressurizing chamber 12 to the side of the damper 10*b*, the valve seat (valve seat) 214S fixed to the fuel passage and the valve (valve member) 203 held so as to be movable by the fuel passage, are disposed. The valve 203 closes and opens the fuel passage when seating on or separating from the valve seat (valve seat) 214S.

According to the present embodiment, similarly to the comparative example, the ring-shaped fuel passage (valve seat portion passage) 10S formed between the valve seat (valve seat) 214S and the valve (valve member) 203, and the fuel introducing passage 10*p* formed on the downstream side of the ring-shaped fuel passage 105, are disposed on the way of the fuel passage from the side of the pressurizing chamber 12 to the side of the damper chamber 10*b*. The valve seat 214S is formed as a plane perpendicular to a central axis line of the plunger rod 201 (drive axis line of the valve 203) (hereinafter, referred to as a valve seat surface), and the fuel introducing passage 10*p* is formed as a fuel passage parallel to the central axis line of the plunger rod 201. Accordingly, a bent flow passage includes the ring-shaped fuel passage 10S and the fuel introducing passage 10P perpendicularly interconnecting with each other. In particular, the valve seat 214S and an inner circumferential surface (outer circumferential surface of the fuel introducing passage 10P) 214D of the valve housing 214 interconnecting with the valve seat 214S, are included in a flow passage surface on the side of an inner circumference of the bent portion. When viewed from a cross-section, parallel to the central axis line of the plunger rod 201, including the central axis line, the inner circumferential surface 214D of the valve housing 214 and the valve seat 214S intersect at the bent portion 214E on the side of the inner circumference (corner portion on the side of the inner circumference) at an angle of 90°. Note that, a slight inclined surface or an R portion for chamfering may be formed at the bent portion 214E on the side of the inner circumference. The widths of the inclined surface and the R portion are much smaller than the width of the valve seat 214S.

Note that, the ring-shaped fuel passage (valve seat portion passage) 10S is a fuel passage portion formed in a gap between the valve seat (valve seat) 214S and the valve (valve member) 203. In the present description, the ring-shaped fuel passage (valve seat portion passage) 10S may be referred to as a radius direction passage portion 10S or a gap passage portion 10S. The fuel introducing passage 10P is a fuel passage portion extending on the downstream side of the gap passage portion 10S in a bent direction with respect to the gap passage portion 10S. In the present description, the fuel introducing passage 10P may be referred to as an axial direction passage portion 10P or a bent passage portion 10P.

The present embodiment is effective for reducing the erosion occurring on a seat surface of the valve seat 214S. The erosion is caused by cavitation. In particular, in a case where the angle at which the inner circumferential surface 214D of the valve housing 214 be with the valve seat 214S, is 90° or less, a fuel flow detaches from a passage surface on the side of the inner circumference (in particular, a passage surface on the downstream side of the bent portion 214E on the side of the inner circumference) at the bent portion 214E on the side of the inner circumference.

According to the present embodiment, a recess portion 214A recessed from a passage surface 214DA on the side of the inner circumference, is formed on the passage surface 214D on the side of the inner circumference of the fuel introducing passage (bent passage portion) 10P positioned on the downstream side of the bent portion 214E on the side of the inner circumference. The recess portion 214A is formed on the valve housing 214 including the valve seat 214S formed therein. An end portion on the upstream side of the recess portion 214A reaches the ring-shaped fuel passage (gap passage portion) 10S. An end portion on the downstream side of the recess portion 214A is disposed over on the way in a fuel flow direction of the fuel introducing passage (bent passage portion) 10P formed on the valve housing 214. Accordingly, a passage surface 214DA that is formed on the valve housing 214, that has a step (D2 to D1) on the recess portion 214A, and that protrudes to the side of the center portion of the fuel introducing passage (bent passage portion) 10P, is provided on the passage surface 214D on the side of the inner circumference of the fuel introducing passage (bent passage portion) 10P positioned on the downstream side of the recess portion 214A.

As described above, air bubbles occur on the valve seat (seat surface) 214S. However, the fuel flow detaches from the passage surface on the side of the inner circumference (in particular, the passage surface on the downstream side of the bent portion 214E on the side of the inner circumference) at the bent portion 214E on the side of the inner circumference, and reaches the passage surface 214DA over the recess portion 214A. In this case, a dead water region DWR is formed in the recess portion 214A. Accordingly, the fuel flow including the air bubbles can be prevented from remaining on the downstream side of the bent portion 214E on the side of the inner circumference. The air bubbles can be prevented from disappearing on the valve seat 214S and in proximity to the valve seat 214S. Accordingly, the erosion can be prevented from occurring on the valve seat 214S and in proximity to the valve seat 214S.

According to the present embodiment, as described above, there is provided a configuration in which the inner circumferential surface 214D of the valve housing 214 and the valve seat 214S intersect at the bent portion 214E on the side of the inner circumference (corner portion on the side of the inner circumference) at an angle of 90°. Even in a case where the angle exceeds 90°, when an angle range of nearly 90° is provided, for example, an angle range of 90° plus a few degrees is provided, there is a possibility that the fuel flow detaches and a whirlpool occurs. When the air bubbles that have occurred on the valve seat 214S, is confined by the whirlpool and remain in proximity to the valve seat 214S, the erosion occurs on the valve seat 214S. Therefore, even when the angle at which the inner circumferential surface 214D of the valve housing 214 be with the valve seat 214S, is in an angle range of 90° plus a few degrees, disposing the recess portion 214A can prevent the erosion from occurring on the valve seat 214S. A configuration in which the angle at which the inner circumferential surface 214D of the valve housing 214 be with the valve seat 214S, is 90° or less, is a limitation of the configuration in which the cavitation, the detachment of the fuel flow, and the erosion on the valve seat 214S occur. Therefore, a configuration in which the cavitation, the detachment of the fuel flow, and the erosion on the valve seat 214S occur, is provided, even when the angle is in the angle range of 90° plus a few degrees, it is allowable that the above angle is assumed to belong in an angle range of substantially 90° or less.

According to the present embodiment, the passage surface 214DA protruding to the side of the center portion of the fuel introducing passage (bent passage portion) 10P, is formed of the valve housing 214 including the step (D2 to D1) on the recess portion 214A. In contrast, as illustrated in FIGS. 5 and 6, a step forming member 214B (in FIG. 5) or 214B' (in FIG. 6) that has a body different from the valve housing 214, may be used so as to form a passage surface 214DA and a step (D2 to D1).

According to the present modification, the step (D2 to D1) and the passage surface 214DA having the step and protruding, from the bottom surface of the recess portion 214A, to the side of the center portion of the bent flow passage portion 10P, are formed of a member different from the valve housing 214 that is the valve seat member. The step and the passage surface 214DA are assembled to the valve housing 214. Accordingly, the step (D2 to D1) and the passage surface 214DA are included in the valve housing 214.

According to the present modification, the entire inner circumferential surface of the valve housing 214 can be formed so as to be the same surface as the bottom surface of the recess portion 214A. Accordingly, the number of processing steps of the valve housing 214 decreases, and manufacturing of the valve housing 214 can be simple.

Figure 5:
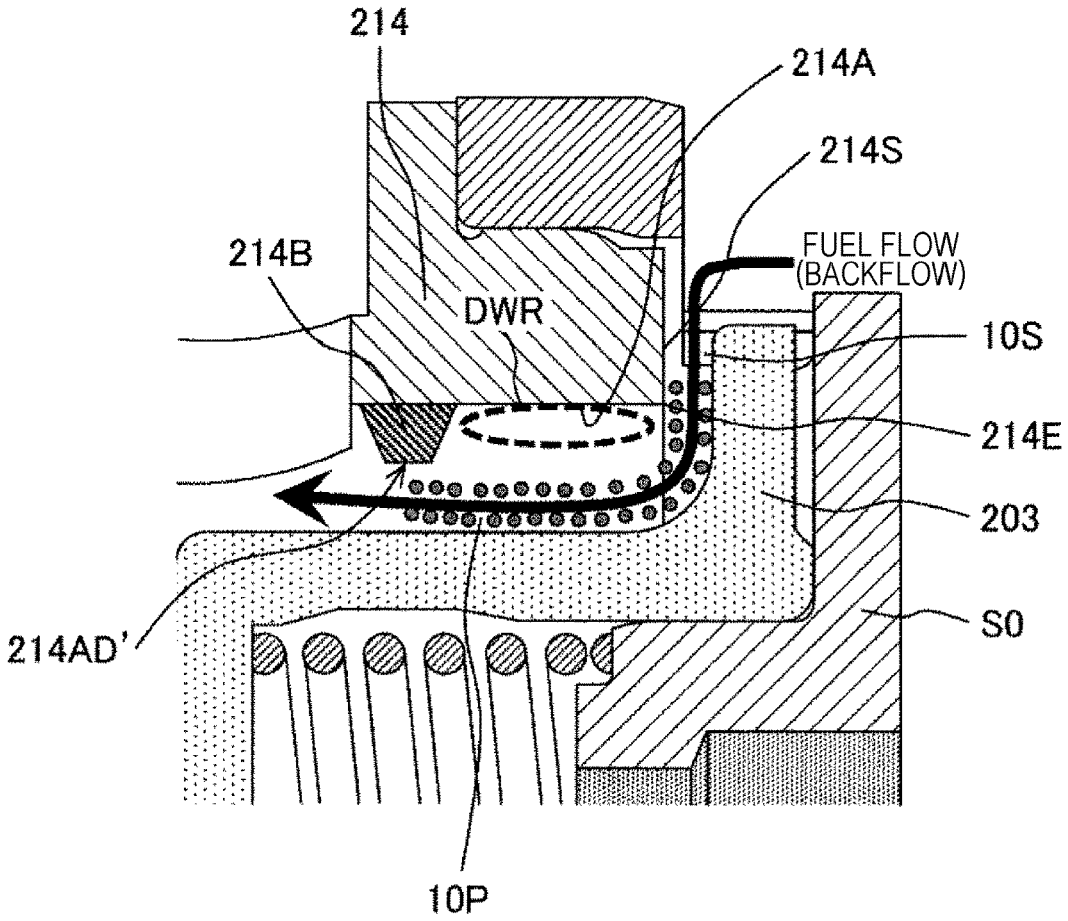
FIG. 5 is a cross-sectional view of proximity to a valve seat and a valve member in an electromagnetic-drive-type suction valve, illustrating a modification of FIG. 4.
Figure 6:
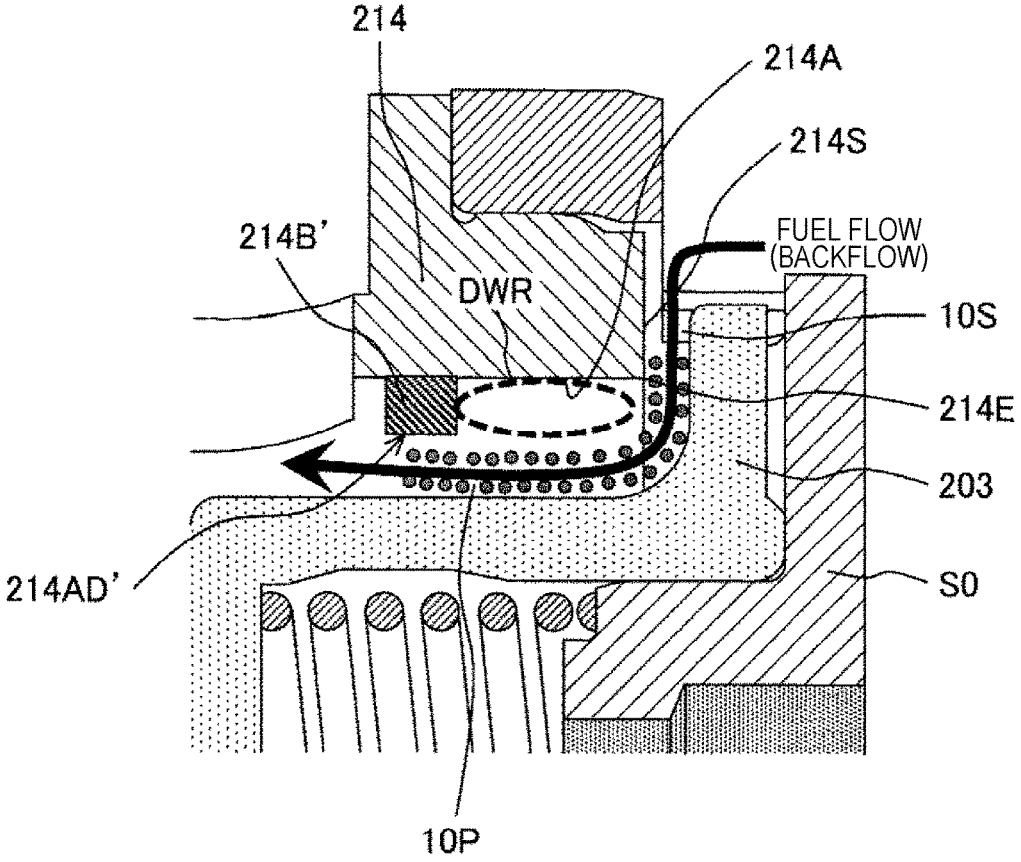
FIG. 6 is a cross-sectional view of proximity to a valve seat and a valve member in an electromagnetic-drive-type suction valve, illustrating another modification of FIG. 4.

Note that, in FIG. 5, the step forming member 214B includes a taper end surface on each of the upstream side and the downstream side thereof. Accordingly, even when the step (D2 to D1) of the step forming member 214B increases in size, turbulence of the fuel flow can be reduced and an increase of passage resistance can be inhibited.

According to the present embodiment, at the axial direction passage portion (bent passage portion) 10P, the recess portion 214A is included in a passage surface of a fuel passage portion having a large diameter. The passage surface 214DA is included in a passage surface of a fuel passage portion having a small diameter with respect to the passage surface of the fuel passage portion having the large diameter.

Second Embodiment

Figure 7:
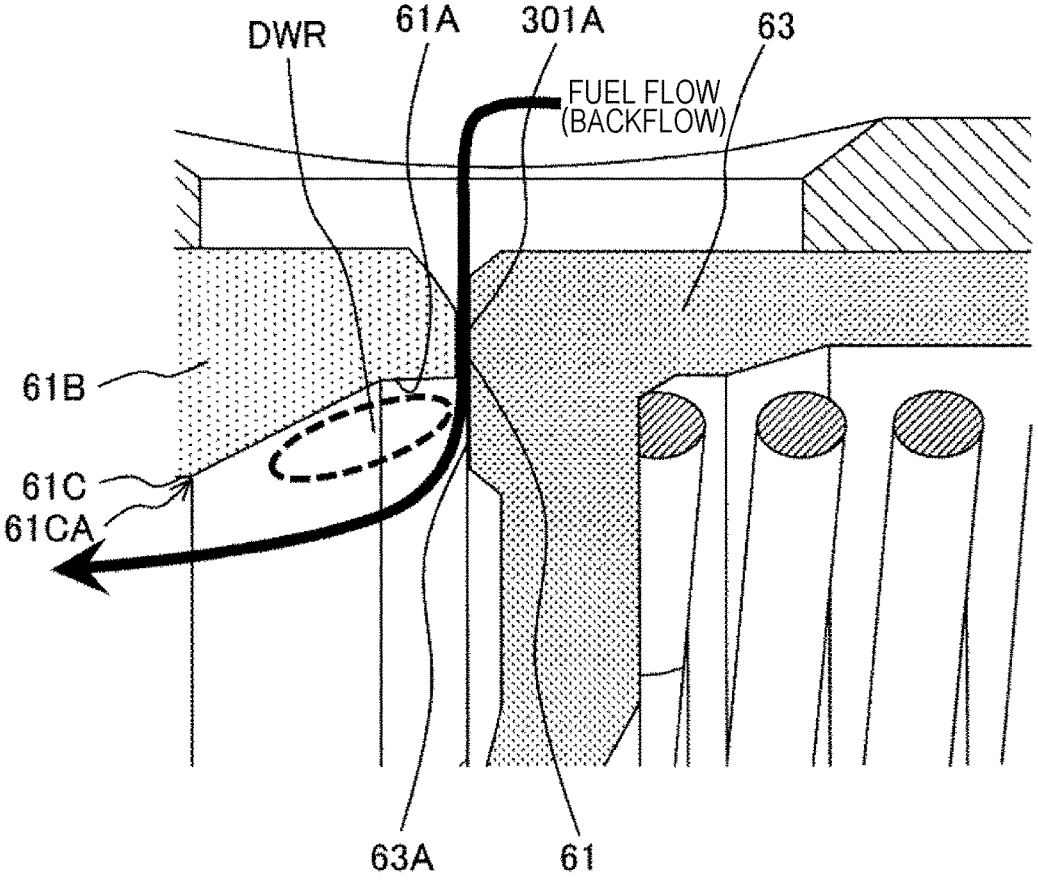
FIG. 7 is a cross-sectional view of an embodiment in which the present invention has been applied to a check valve included in a delivery valve.

A second embodiment of the present invention will be described with reference to FIG. 7. FIG. 7 is across-sectional view of the embodiment in which a recess portion according to the present invention has been applied to a check valve included in a delivery valve unit 60.

According to the present embodiment, a valve seat (valve seat) 61 is formed on an end surface of a valve seat member 61B. The valve seat 61 is formed as a plane perpendicular to a drive axis direction of a valve (valve member) 63. A through-hole 61C passing through in the drive axis direction of the valve 63, is formed on a center portion (central portion) of the valve seat member 61B. The through-hole 61C is included in a fuel passage 61C. Meanwhile, an end surface of the valve 63 facing the valve seat 61 seats on or separates from the valve seat 61 so as to close or open a fuel passage, respectively. Accordingly, the valve seat 61 is fixed to the fuel passage, and the valve 63 is held by the fuel passage so as to be movable.

In the delivery valve unit 60, for example, a backflow occurs during a period during which the valve 63 moves from a valve-opening position to a valve-closing position after a discharge of the fuel has been completed. In the descriptions of the present embodiment, the backflow state is defined as a reference, and an upstream side and a downstream side are set. When the backflow occurs in the delivery valve unit 60, the fuel flows to the valve seat 61 and from the side of the outer circumference to the side of the inner circumference of the valve 63 in FIG. 7.

A gap passage portion (radius direction passage portion) 301A formed in a gap between the valve seat 61 and the valve 63, is disposed on the way of the fuel passage through which the fuel flow flows from a delivery joint 11 to the side of a pressurizing chamber 12 upon the backflow. On the downstream side of the gap passage portion 301A, the fuel passage portion 61C extending in a bent direction with respect to the gap passage portion 301A, is disposed. The fuel passage portion 61C is formed in the drive axis direction of the valve 63, and may be referred to as an axial direction passage portion 61C or a bent passage portion 61*c*.

The gap passage portion 301A corresponds to the ring-shaped fuel passage 10S according to the first embodiment. The bent passage portion 61C corresponds to the bent passage portion 10P according to the first embodiment. The through-hole (fuel passage) 61C corresponds to the passage surface 214D on the side of the inner circumference according to the first embodiment. A passage surface 61CA of the bent passage portion 61C corresponds to the passage surface 214DA according to the first embodiment. The recess portion 61A corresponds to the recess portion 214A according to the first embodiment. The valve (valve member) 203 is disposed on the inside of the valve housing 214 having the valve seat 214S according to the first embodiment, whereas the valve 63 is disposed on the outside of the valve seat member 61B having the valve seat 61 according to the present embodiment.

The recess portion 61A and the passage surface 61CA have an effect similar to that of the recess portion 214A and the passage surface 214DA according to the first embodiment. Thus, erosion on the valve seat 61 can be reduced.

Note that, according to the present embodiment, at the axial direction passage portion (bent passage portion), the recess portion 61A is included in a passage surface of a fuel passage portion having a large diameter. The passage surface 61C is included in a passage surface of a fuel passage portion having a small diameter with respect to the passage surface of the fuel passage portion having the large diameter.

According to the present embodiment, in a manner similar to the modifications in FIGS. 5 and 6 according to the first embodiment, the passage surface 61CA and a step between the bottom surface of the recess portion 61A and the passage surface 61CA may be formed of a member different from the valve seat member 61B that is a valve member, and may be assembled to the valve seat member 61B. Then, the passage surface 61CA and the step may be included in the valve seat member 61B. In this case, the passage surface 61CA serves as a passage surface protruding from the bottom surface of the recess portion 61A to the side of the center portion of the fuel passage) 61C due to the step.

Third Embodiment

Figure 8:
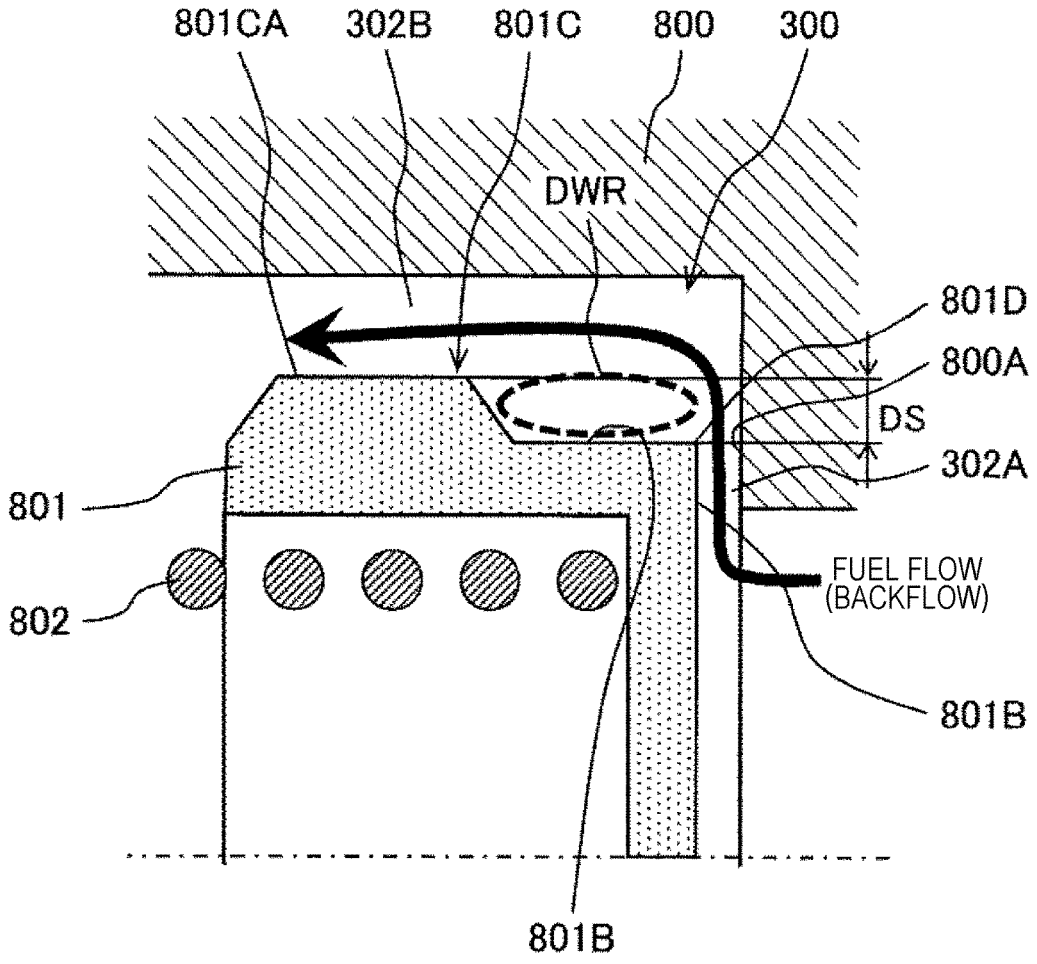
FIG. 8 is a cross-sectional view of an embodiment in which the present invention has been applied to an inward-opening valve.

A third embodiment of the present invention will be described with reference to FIG. 8. FIG. 8 is a cross-sectional view of the embodiment in which the present invention has been applied to an inward-opening valve.

In the inward-opening valve according to the present embodiment, a valve seat 800A is formed on the valve seat member 800, and a valve member 801 is disposed on the inside of the valve seat member 800. A fuel flow to be a backflow flows from the inside to the outside in a radius direction through a gap passage portion 302A formed between the valve seat 800A and the valve member 801. In the following descriptions, the backflow state is defined as a reference, and an upstream side and a downstream side are set. Then, the descriptions will be given.

A bent passage portion (axial direction passage portion) 302B extending in a bent direction with respect to the gap passage portion 302A, is disposed on the downstream side of the gap passage portion 302A.

The valve seat 800A is formed as a plane perpendicular to a drive axis line of the valve member 801, and the bent passage portion 302B is formed as a fuel passage parallel to the drive axis line (central axis line) of the valve member 801. Accordingly, a bent flow passage includes the gap passage portion 302A and the bent passage portion 302B perpendicularly interconnecting with each other. In particular, an abutting surface (end surface) 801B of the valve member 801 abutting on the valve seat 800A and an outer circumferential surface 801C of the valve member 801 interconnecting with the abutting surface 801B, are included in a flow passage surface on the side of the inner circumference of the bent portion in the fuel passages 302A and 302B. When viewed from a cross-section (in FIG. 8), parallel to the central axis line of the valve member 801, including the central axis line, the abutting surface (end surface) 801B of the valve member 801 and the outer circumferential surface 801C of the valve member 801 intersect at a bent portion 801D on the side of the inner circumference (corner portion on the side of the inner circumference) at angle of 90°. Note that, a slight inclined surface or an R portion for chamfering may be formed at the bent portion 801D on the side of the inner circumference. The widths of the inclined surface and the R portion are much smaller than the width of the valve seat 800A.

According to the present embodiment, a recess portion 801A recessed from a passage surface 801CA on the side of the inner circumference, is formed on the passage surface 801C on the side of the inner circumference (outer circumferential surface of the valve member 801) of the bent passage portion 302B positioned on the downstream side of the bent portion 801D on the side of the inner circumference. The recess portion 801A is formed on the valve member 801. An end portion of the upstream side of the recess portion 801A reaches the gap passage portion 302A. An end portion on the downstream side of the recess portion 801A is disposed over the way in a fuel flow direction of the bent passage portion 302B formed on the outer circumferential surface 801C of the valve member 801. Accordingly, the passage surface 801CA that is formed on the valve member 801, that has a step DS on the recess portion 801A, and that protrudes to the side of a center portion of the bent passage portion 302B, is provided on the passage surface 801C on the side of the inner circumference of the bent passage portion 302B positioned on the downstream side of the recess portion 801A.

The gap passage portion 302A corresponds to the ring-shaped fuel passage 10S according to the first embodiment. The bent passage portion 302B corresponds to the bent passage portion 10*p* according to the first embodiment. The passage surface 801C on the side of the inner circumference including the outer circumferential surface of the valve member 801, corresponds to the passage surface 214D on the side of the inner circumference according to the first embodiment. The passage surface 801CA corresponds to the passage surface 214DA according to the first embodiment. The recess portion 801A corresponds to the recess portion 214A according to the first embodiment. The recess portion 214A is formed on the passage surface on the side of the outer circumference of the bent passage portion 10*p* according to the first embodiment, whereas the recess portion 801A is formed on the passage surface on the side of the inner circumference of the bent passage portion 302B according to the present embodiment.

The recess portion 801A and the passage surface 801CA have an effect similar to that of the recess portion 214A and the passage surface 214DA according to the first embodiment. Thus, erosion on the valve seat 800A can be reduced.

REFERENCE SIGNS LIST

10*b* damper chamber
10P bent passage portion
10S gap passage portion
11 delivery joint
12 pressurizing chamber
60 delivery valve unit
61 valve seat
61B valve seat member
61A recess portion
61B valve seat member
61C bent passage portion
61CA passage surface
valve
200 electromagnetic-drive-type suction valve mechanism
203 valve
214 valve housing
214A recess portion of passage surface 214D on the side of inner circumference
214B, 214B' step forming member
214D inner circumferential surface of valve housing 214
214DA passage surface
214E bent portion on the side of inner circumference of bent fuel passage (corner portion on the side of inner circumference)
214S valve seat
301A gap passage portion
302A gap passage portion
302B bent passage portion
800 valve seat member
800A valve seat
801 valve member
801A recess portion
801B abutting surface of valve member 801
801C outer circumferential surface of valve member 801
801CA passage surface on the side of inner circumference
801D bent portion on the side of inner circumference (corner portion on the side of inner circumference)
DS step
DWR dead water region

The invention claimed is:

1. A high-pressure fuel supply pump comprising:
a plunger configured to be in reciprocating motion;
a pressurizing chamber of fuel in which volume varies due to the reciprocating motion of the plunger;
a fuel passage interconnecting with the pressurizing chamber; and
a fluid valve disposed on the fuel passage,
wherein the fluid valve includes
a valve seat fixed to the fuel passage, and
a valve member held movable by the fuel passage, and configured to close or open the fuel passage by seating on or separating from the valve seat,
the fuel passage includes
a gap passage portion formed in a gap between the valve seat and the valve member, and a bent passage portion extending in a bent direction with respect to the gap passage portion, on the downstream side of the gap passage portion, in a case where a flow direction is defined as a reference upon a backflow of the fuel, in terms of a passage surface on the side of an inner circumference of a bent fuel passage portion including the gap passage portion and the bent passage portion, a recess portion is formed on an end portion on the upstream side of a passage surface of the bent passage portion, and an inner surface of the valve member, on a side thereof that faces the valve seat, has a convex shape in an area of the valve member that is between the bent passage portion and the gap passage portion.

2. The high-pressure fuel supply pump according to claim 1, wherein in terms of an interval between a passage surface on the side of the inner circumference and a passage surface on the side of an outer circumference at the bent passage portion, an interval D1 at a portion at which the recess portion is formed is larger than an interval D2 at a portion on the further downstream side of a downstream end of the recess portion.

3. The high-pressure fuel supply pump according to claim 2, wherein an end portion on the upstream side of the recess portion interconnects with the gap passage portion.

4. The high-pressure fuel supply pump according to claim 3, wherein the recess portion is formed on a valve seat member including the valve seat formed or on the valve member.

5. The high-pressure fuel supply pump according to claim 4, wherein a passage surface having a step and protruding from a bottom surface of the recess portion to the side of a central portion of the bent flow passage portion due to the formation of the recess portion, is included in the recess portion and the valve seat member or the valve member.

6. The high-pressure fuel supply pump according to claim 5, wherein the angle between a passage surface included in the gap passage portion and the passage surface included in the bent passage portion, is 90° or less, the passage surfaces positioned on the side of the inner circumference of the bent fuel passage portion including the gap passage portion and the bent passage portion.

7. The high-pressure fuel supply pump according to claim 5, wherein the step and the passage surface having the step and protruding from the bottom surface of the recess portion to the side of the center portion of the bent flow passage portion, are formed of a member different from the valve seat member or the valve member and are assembled to the valve seat member or the valve member.

* * * * *